US006123372A

United States Patent [19]

Rogers, Jr. et al.

[11] Patent Number: 6,123,372

[45] Date of Patent: Sep. 26, 2000

[54] DOOR LATCH

[75] Inventors: Lloyd Walker Rogers, Jr., Shelby Township, Macomb County; Ian Martin, Waterford; Artur Jerzy Ostrowski, Rochester Hills, all of Mich.

[73] Assignee: Delphi Technologies, Inc., Troy, Mich.

[21] Appl. No.: 09/358,120

[22] Filed: Jul. 21, 1999

[51] Int. Cl.[7] ..... E05C 3/06

[52] U.S. Cl. ..... 292/216; 292/201; 292/DIG. 43

[58] Field of Search ..... 292/201, 216, 292/DIG. 43, DIG. 23, DIG. 65, 125, 225

[56] References Cited

U.S. PATENT DOCUMENTS

| | | | |
|---|---|---|---|
| 4,998,758 | 3/1991 | Kowalczyk | 292/201 |
| 5,429,400 | 7/1995 | Kawaguchi | 292/201 |
| 5,639,130 | 6/1997 | Rogers | 292/216 |
| 5,720,506 | 2/1998 | Arabia | 292/216 |
| 5,738,394 | 4/1998 | Arabia | 292/216 |
| 5,918,917 | 7/1999 | Elton | 292/201 |
| 6,050,619 | 4/2000 | Arabia | 292/216 |
| 6,053,542 | 4/2000 | Ostrowski | 292/201 |

*Primary Examiner*—B. Dayoan
*Assistant Examiner*—Gary Estremsky
*Attorney, Agent, or Firm*—Patrick M. Griffin

[57] ABSTRACT

A door latch (10) with a cinching mechanism (16) having a manual override (18). The door latch (10) includes an enclosure (12) and a latching mechanism (14) disposed in the enclosure. The latching mechanism (12) has a fork bolt (20) moveable between an unlatched position, a secondary latched position, and a primary latched position. The cinching mechanism (16) has a cinching gear (24) that can drive the fork bolt (20) to the primary latched position. The cinching mechanism (16) also has a gear lever (30) to drive the cinching gear (24). A motor driven cable (34), in turn, drives the gear lever (30). A conduit (44) extends over part of the cable (34). The conduit (44) is attached to a conduit lever (46), which, in turn attaches to the enclosure (12). The manual override (18) includes a pivoting connection (50) that interconnects the conduit lever (46) and the enclosure (12) to allow the conduit lever and the conduit (44) to pivot with respect to the enclosure selectively between a fixed position and a loose position. The override (18) also includes a detent (52). The detent (52) can either engage the conduit lever (46) and retain it in a fixed position, or disengage the conduit lever to allow the conduit lever and the conduit (44) to pivot. If the conduit (44) is allowed to pivot, the latching mechanism (14) can unlatch even if the cinching mechanism (16) fails to operate after it drives the fork bolt (20) to the primary latched position.

10 Claims, 6 Drawing Sheets

DOOR LATCH

TECHNICAL FIELD

The present invention relates to vehicle door latches having a cinching mechanism, and more particularly to a manual override for such door latches.

BACKGROUND OF THE INVENTION

Cinching mechanisms are commonly used now in connection with vehicle doors. They operate to fully latch a door that is only partly latched as a result of someone closing the door without sufficient force to effect a fully latched (i.e primary latched) condition. The cinching mechanisms essentially pull the door to a fully latched condition with some type of motor-powered mechanism.

In a common case, the mechanism includes some driving means for engaging and driving a door latch fork bolt from a partly-latched to a fully-latched condition. Once this occurs, the driving means then disengages the fork bolt to permit unlatching. If the driving means fails to disengage the fork bolt, there must be some way to override the driving means to allow the fork bolt to rotate to an unlatched condition wherein the door can be opened.

There are several manual override mechanisms now in use. But most involve complicated arrangements having several parts. One such example is shown in U.S. Pat. No. 5,639,130 to Rogers et al. This assembly works well, but vehicle cost and weight can be reduced by devising a simpler design with fewer parts.

Another override mechanism involves a cable-driven cinching mechanism that is similar to the cinching mechanism in the present case. The manual override mechanism includes a separate linkage between the gear lever and the latch handle assembly. This linkage allows unlatching even in the odd event that the drive mechanism fails to return to a neutral position. The linkage basically disengages the cinching gear and the gear lever to allow free movement of the fork bolt even though the cable continues to hold the gear lever down in a driving position. But the linkage presents packaging problems for a door environment that can be crowded with other parts.

SUMMARY OF THE INVENTION AND ADVANTAGES

A door latch with a cinching mechanism having a manual override comprises an enclosure, a latching mechanism, a cinching mechanism, and a manual override. The latching mechanism includes a fork bolt pivotally mounted on the enclosure about a fork bolt axis operable for selective movement between an unlatched position, a secondary latched position, and a primary latched position.

The cinching mechanism includes a cinching gear pivotally mounted on the enclosure adjacent the fork bolt about a cinching gear axis. The cinching gear engages the fork bolt, and is operable to drive the fork bolt to the primary latched position. The cinching mechanism also includes a gear lever moveably supported on the enclosure adjacent the cinching gear. The gear lever is operable to drive the cinching gear. The cinching mechanism also includes an elongated cinching cable having a first end and a second end, the first end being attached to the gear lever. Further, a cable drive is disposed at the second end of the cinching cable to pull and release the cable. A cable conduit extends over and supports a length of the cable between the drive and the gear lever, the cable conduit having a first end disposed adjacent the drive and a spaced apart second end disposed adjacent the enclosure. A conduit lever is attached to the enclosure remote from the gear lever, the second end of the cable conduit being attached to the conduit lever. A spring extends along the cable between a first end and a second end, the first end disposed adjacent the conduit lever and the second end disposed adjacent the gear lever.

The manual override includes a pivoting connection that interconnects the conduit lever and the enclosure to allow the conduit lever and the conduit to pivot with respect to the enclosure selectively between a fixed position and loose position. The manual override also includes a detent supported on the enclosure adjacent the conduit lever. The detent is operable to move from an engaged position in which the detent engages the conduit lever and retains the conduit lever in the fixed position, and a disengaged position in which the detent disengages the conduit lever to allow the conduit lever to pivot to the loose position.

The invention overcomes the limitations in the prior art by providing a simple and compact door latch having a cinching mechanism with a manual override.

FIGURES IN THE DRAWINGS

The present invention will now be described, by way of example, with reference to the accompanying drawings, in which.

Figure 4:
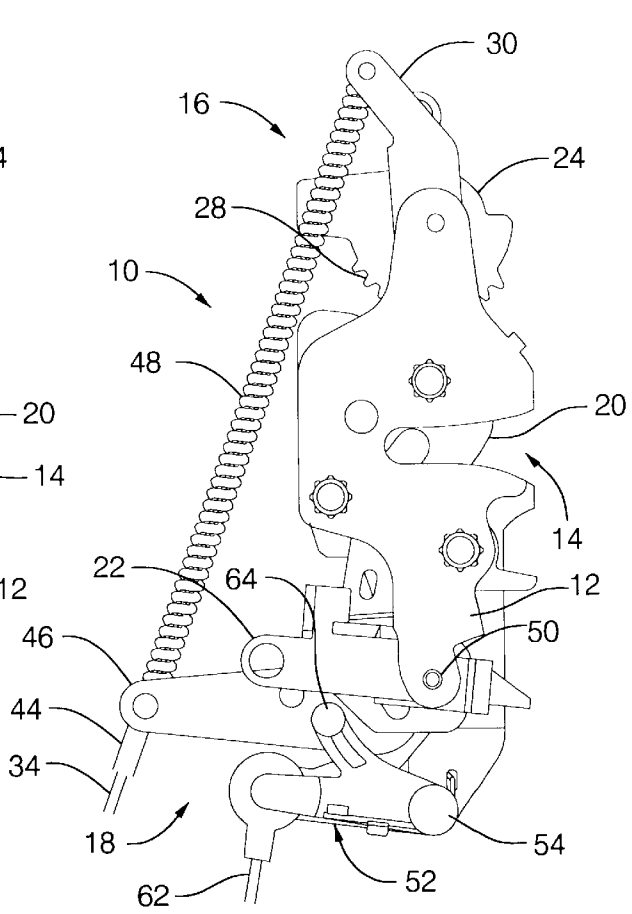
Figure 3:
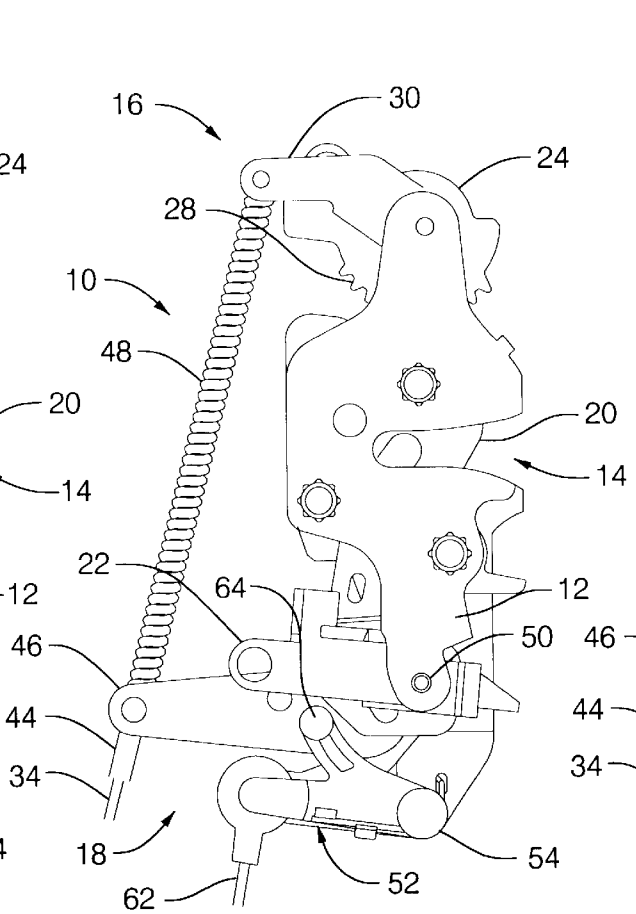
Figure 6:
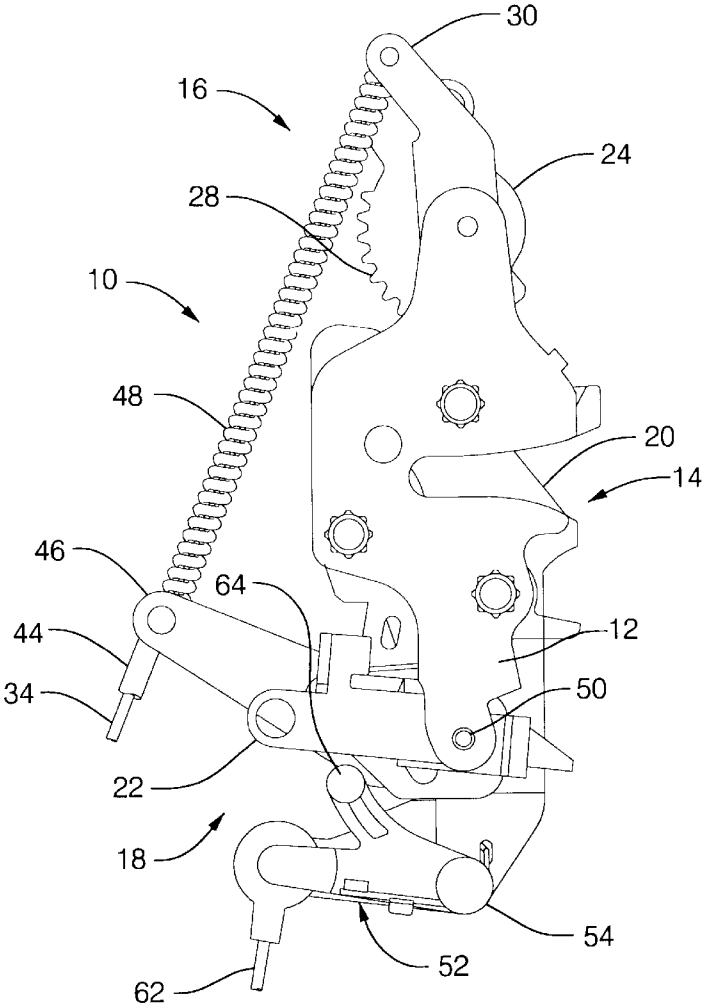
Figure 5:
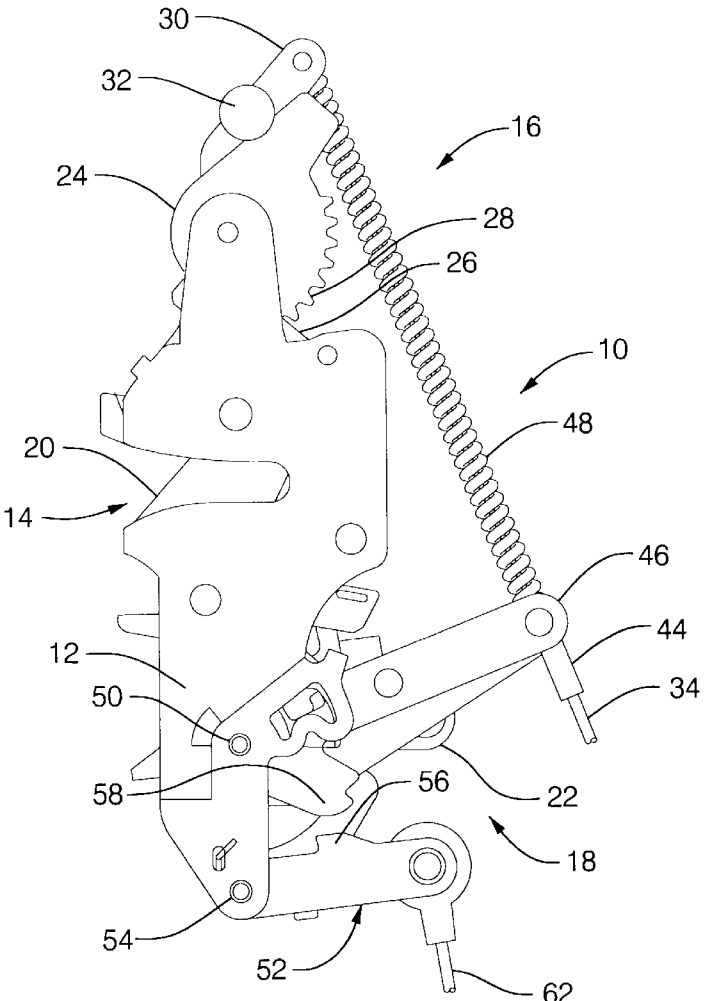
Figure 7B:
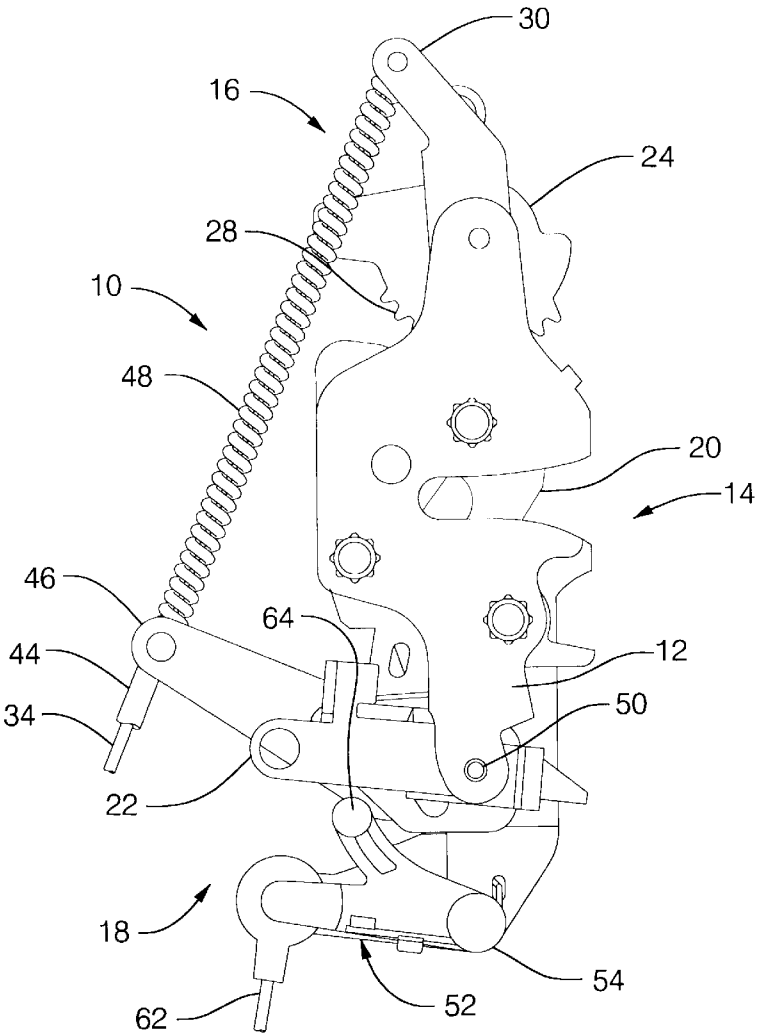
Figure 7A:
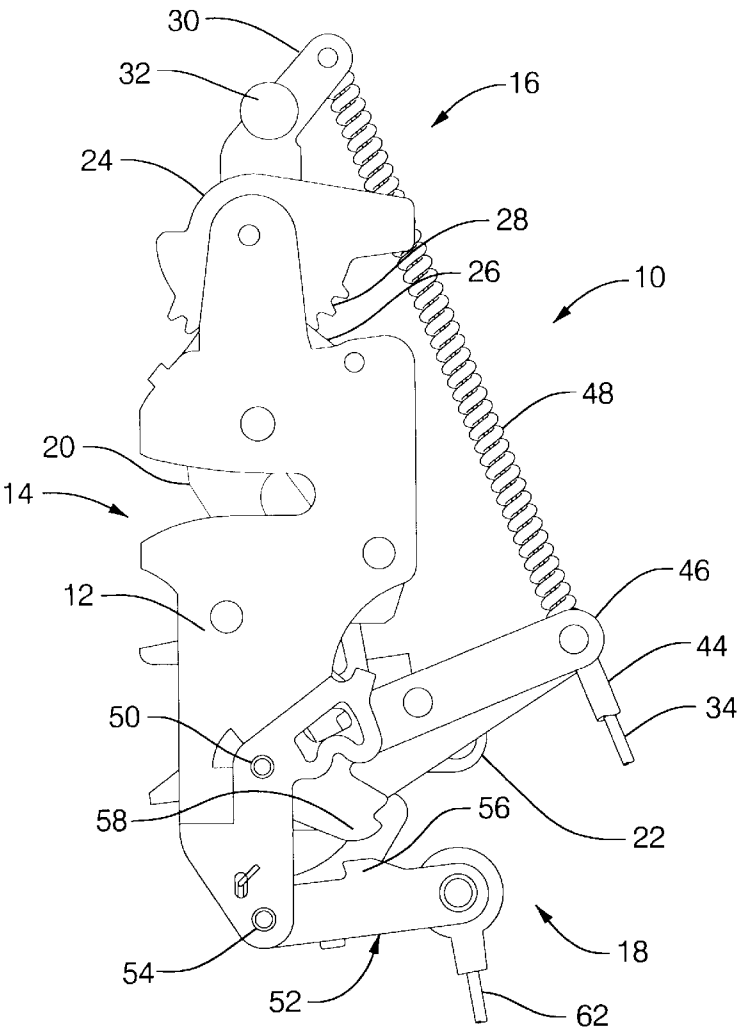
Figure 8:
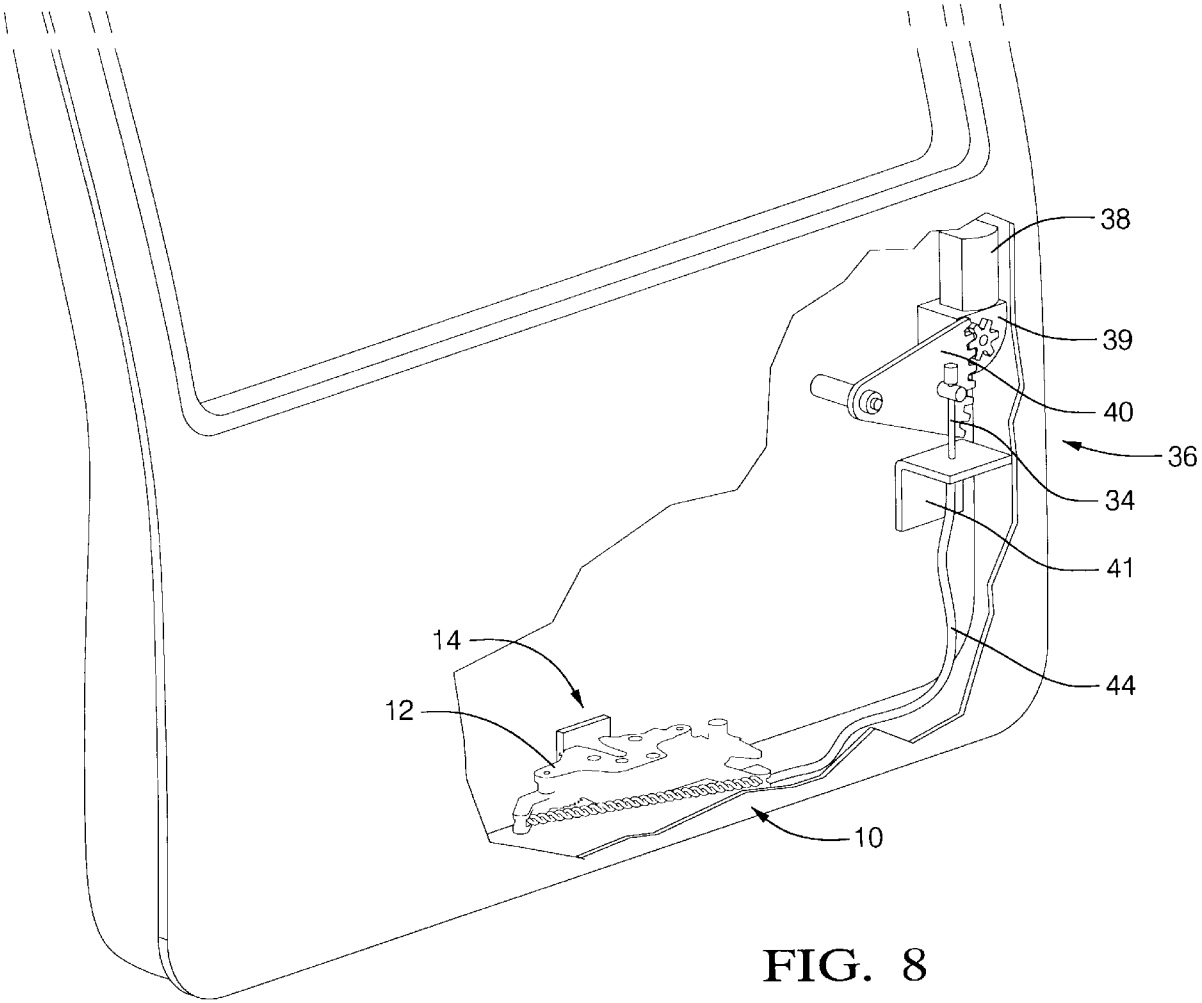

FIG. 3 a left end view of the present door latch showing the cinching mechanism operating to drive the fork bolt into the primary latched position;

FIG. 4 is a left end view of the present door latch showing the cinching mechanism relaxed after driving the fork bolt into the primary latched position;

FIG. 5 is a right end view of the present door latch showing the detent in the disengaged position, allowing the fork bolt to move to the unlatched position even if the cinching mechanism fails to relax;

FIG. 6 is a left end view of the present door latch showing the same state shown in FIG. 5;

FIG. 7A is a right end view of the present door latch showing the detent still in the disengaged position and the fork bolt in the primary latched position;

FIG. 7B is a left end view of the present door latch showing the same state shown in FIG. 7A; and FIG. 8 is an environmental view showing the assembly in the tail gate of a vehicle.

DESCRIPTION OF THE PREFERRED EMBODIMENT

The present invention will now be described, by way of example, with reference to the accompanying drawings in which a door latch assembly having a cinching mechanism with a manual override is generally shown at 10.

The entire assembly 10 includes an enclosure 12, a latching mechanism generally shown at 14; a cinching mechanism generally shown at 16, and a manual override generally shown at 18.

The latching mechanism 14 includes a fork bolt 20 pivotally mounted on the enclosure 12 about a fork bolt axis operable for selective movement between an unlatched position, a secondary latched position, and a primary latched position. The latching mechanism 14 includes other components as shown in the FIGS. The latching mechanism is a well-known mechanism that has already been used in millions of vehicles. It is disclosed in detail in U.S. Pat. No. 4,756,563 granted to Garwood et al.; U.S. Pat. No. 5,054,827 granted to Konchan et al.; and U.S. Pat. No. 5,277,461 to granted Dzurko et al. The teachings of these patents are incorporated here by reference. This is the preferred latching mechanism, although the exact form of the latching mechanism is not critical to the invention, and so it may vary.

The latching mechanism 14 includes a latch handle assembly 22 interconnected in some manner with the fork bolt 20. The latch handle assembly 22 is operative to move from a neutral position to an unlatching position wherein the latch handle assembly allows the fork bolt 20 to move to the unlatched position. In the typical case, the latch handle assembly 22 will interconnect with some sort of detent mechanism that holds the fork bolt in either the secondary or primary latched positions. The latch handle assembly 22 can move the detent mechanism to release the fork bolt 20 and allow the fork bolt to move to the unlatched position. A specific latch handle assembly is shown in the above-referenced patents. But the invention does not depend on the latch handle assembly having any particular configuration. For example, the latch handle assembly 22 may be a combined inside and outside latch handle assembly in the event that the latch is for a passenger door; or it may simply be an outside latch handle assembly in the event that the latch is for a tail gate.

The cinching mechanism 16 includes several parts that act together to drive the fork bolt 20 from the secondary position to the primary latched position. The present cinching mechanism 16 will not move the fork bolt 20 unless it is in the secondary position. One part is a cinching gear 24 pivotally mounted on the enclosure 12 adjacent the fork bolt 20 about a cinching gear axis. The cinching gear 24 engages the fork bolt 20 and is operable to drive the fork bolt to the primary latched position. To accomplish this, the fork bolt 20 includes a first set of gear teeth 26 that engage a second set of gear teeth 28 on the cinching gear 24.

The cinching mechanism 16 also includes a gear lever 30 moveably supported on the enclosure 12 adjacent the cinching gear 24, where the gear lever 30 is operable to drive the cinching gear 24. The gear lever 30 is pivotally mounted on the enclosure 12 about the cinching gear axis. The gear lever 30 includes a cam 32 for engaging and driving the cinching gear 24. The cam 32 is essentially an abutment or projection that extends away from the gear lever 30 in the manner shown. The cam 32 can be fastened to the gear lever 30 or molded as part of the gear lever.

An elongated cinching cable 34 has a first end and a second end, where the first end is attached to the gear lever 30 as shown in the FIGS.

A cable drive generally shown at 36 is disposed at the second end of the cinching cable 34 and is operable to pull and release the cable. Such a cable drive is well-known and already in use. The exact configuration of the cable drive 36 is not critical to the invention. It is expected that the cable drive can "release" the cable in any one of a number of ways, including reversing the cable. In the present case, the drive 36 includes an electric motor assembly 38, a gear box 39 and a pivoting sector gear 40. The cable drive 36 also includes a flange 41. The motor assembly 38 drives a gear arrangement in the gear box 39, and the gear box in turn drives the sector gear 40 through its pivoting movement. As shown in FIG. 8, the cable 34 attaches to the sector gear 40 so that, as the sector gear pivots, the sector gear will pull or reverse the cable, depending on the direction of pivoting.

A cable conduit 44 extends over and supports a length of the cable 34 between the drive 36 and the gear lever 30. The cable conduit 44 has a first end disposed adjacent the drive 36 and a spaced-apart second end disposed adjacent the enclosure 12. As shown in FIG. 8, the first end of the conduit 44 attaches to the flange 41.

A conduit lever 46 is attached to the enclosure 12 remote from the gear lever 30. In the present case, the conduit lever 46 is disposed near the bottom of the enclosure 12 as shown in the FIG. . The second end of the cable conduit 44 attaches to the conduit lever 46.

Figure 2:
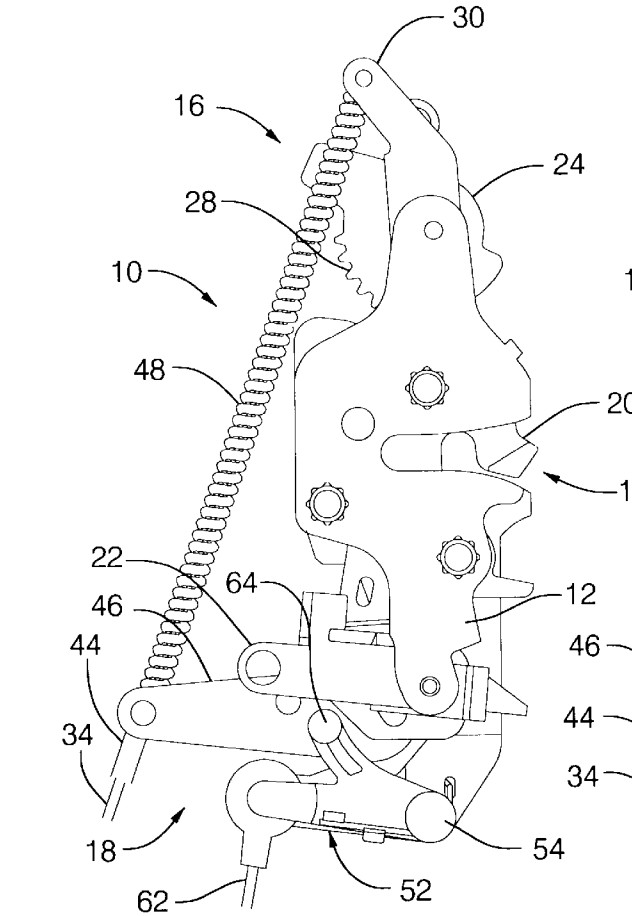
FIG. 2 is a left end view of the present door latch showing the fork bolt in the secondary latched position.

A spring 48 extends along the cable 34 between a first end and a second end, the first end being disposed adjacent the conduit lever 46 and the second end being disposed adjacent the gear lever 30. The spring 48 is a helical compression spring. The spring's relaxed state is shown in FIG. 2, for example; and the compressed state is shown in FIG. 3. The spring 48 biases the gear lever 30 upwardly in a direction opposite to the direction of driving. This is shown clearly in FIGS. 2 and 4, for example. The spring 48 also biases the conduit lever 46 in a downward direction.

As noted, the assembly 10 also includes a manual override 18 for the unusual case where the cable drive 36 stalls after driving the fork bolt 20 into or near the primary latched position. In other words, the manual override 18 addresses the situation where the motor 38 fails to release, relax, reverse, return or unwind the cable 34 so that the gear lever 30 may travel upwardly to the neutral or non-driving position shown in FIG. 4.

The manual override 18 includes a pivoting connection 50 interconnecting the conduit lever 46 and the enclosure 12 at some predetermined attachment point on the enclosure. This allows the conduit lever and the conduit 44 to pivot with respect to the enclosure 12 selectively between a fixed position and loose position. This feature is a distinction over the prior art cinching mechanism, wherein the conduit is fixedly attached to the enclosure, and not capable of moving with respect to the enclosure. The pivoting connection 50 includes a pin extending through the enclosure 12 and the conduit lever 46 to allow the conduit lever to pivot as shown.

The conduit 44 is installed to include a degree of curvature as shown in FIG. 8. In other words, it should not extend in a straight line from the drive 36 to the conduit lever 46. The curvature provides slackness in the conduit 44 that allows the conduit lever 46 and the conduit 44 to pivot into the loose position shown in FIGS. 5, 6, and 7.

Figure 1B:
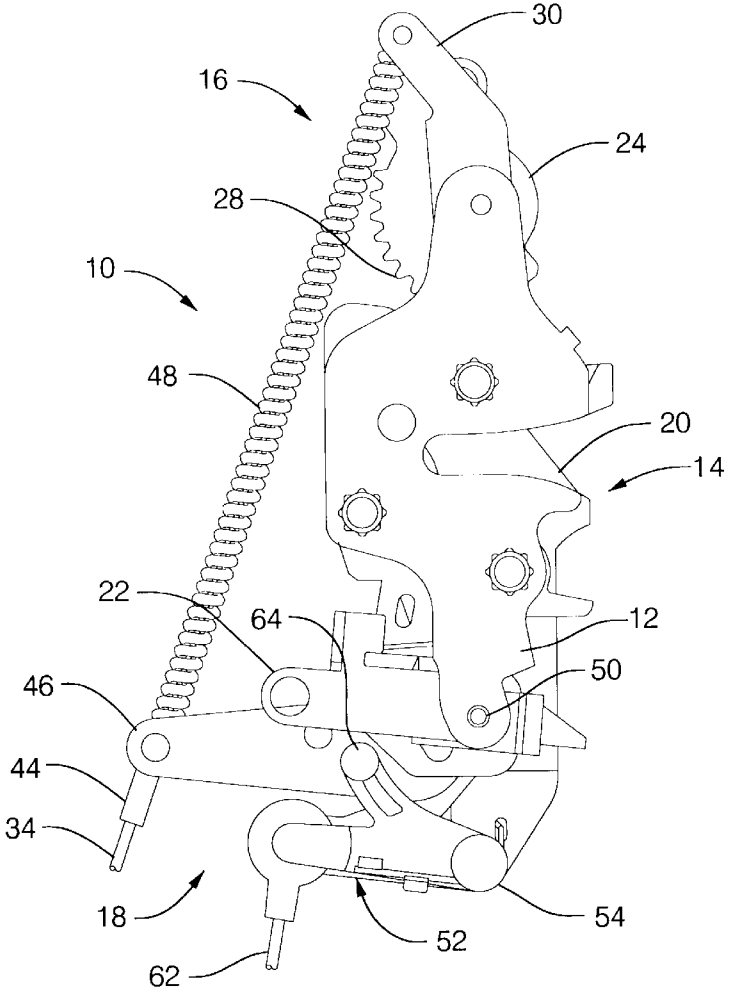
FIG. 1B is a left end view of the present door latch also showing the fork bolt in the unlatched position.
Figure 1A:
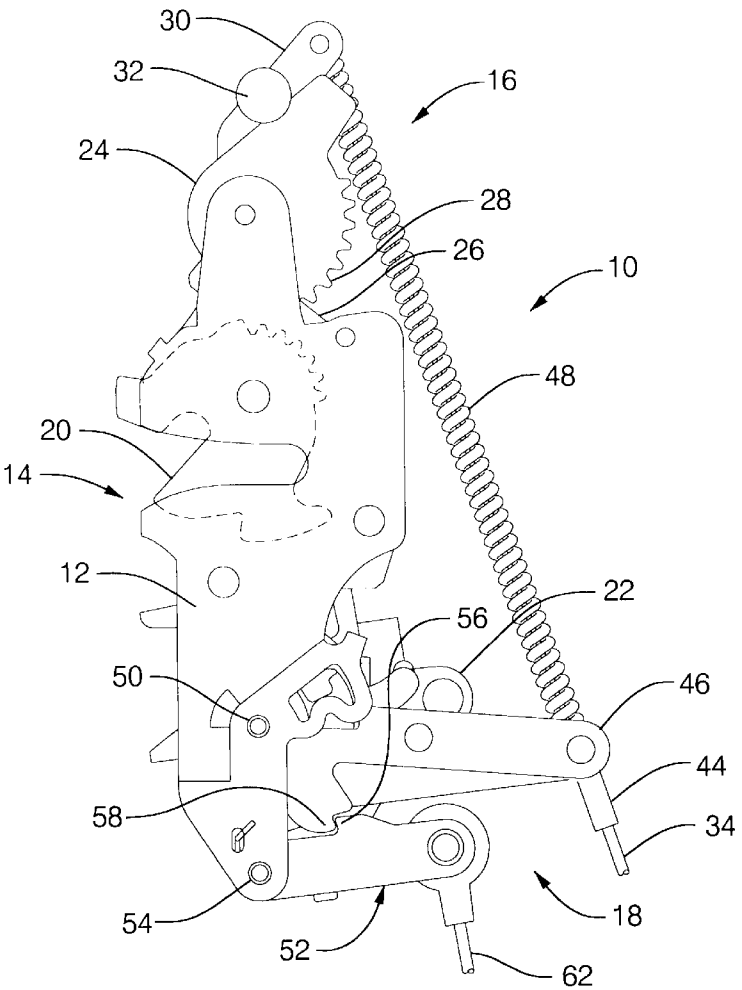
FIG. 1A is a right end view of the present door latch showing the fork bolt in the unlatched position.

The manual override 18 also includes a detent generally indicated at 52 that is pivotally supported on the enclosure 12 adjacent the conduit lever 46 and that is operable to move from an engaged position to a disengaged position. A pivot pin 54 or the like extends through the enclosure 12 and the detent 52 to provide this pivoting relationship. In the engaged position, the detent 52 engages the conduit lever 46 and retains the conduit lever in the fixed position. In the disengaged position, the detent 52 disengages the conduit lever 46 to allow the conduit lever to pivot to the loose position. As shown in FIG. 1A, for example, the detent 52 includes a first projection 56 which mates with a second projection 58 on the conduit lever 46 to maintain the conduit lever in the fixed position. The detent 52 also includes a detent spring 60 to bias the detent into the engaged position. The detent spring 60 is a torsion spring interposed between the enclosure 12 and a portion of the detent 52.

The detent 52 may include a release cable 62 extending away from the detent that can be pulled to move the detent into the disengaged position. The release cable 62 has a remote end that should be placed in a convenient location—perhaps in the inside tailgate section of the vehicle or in the trunk. A person should be able to access the remote end of the release cable 62 to move the detent 52 into the disengaged position, if necessary.

The detent 52 further might include an abutment 64 disposed adjacent the latch handle assembly 22 so that the latch handle assembly will engage the abutment 64 and move the detent 52 into the disengaged position when the latch handle assembly moves to the unlatching position. The abutment 64 might be molded as part of the detent 52, as shown in the figures; or it might be a separate item fastened to the detent. In any case, including an abutment 64 as part of the detent is another convenient way to manually override the cinching mechanism 16 in the event of a drive failure.

The present door latch 10 will, in operation, include some electronic circuitry. For example, there will be at least two switches, a power source and a control for controlling the drive 36. The circuitry in any case is conventional and is not part of the improvement that the invention represents. In one possible embodiment, there will be two switches, one associated with the fork bolt 20 and one associated with the detent (not shown) that holds the fork bolt in the secondary and primary positions. The switches will sense the location of the fork bolt and the control will control the drive 36 accordingly.

Figure 1C:
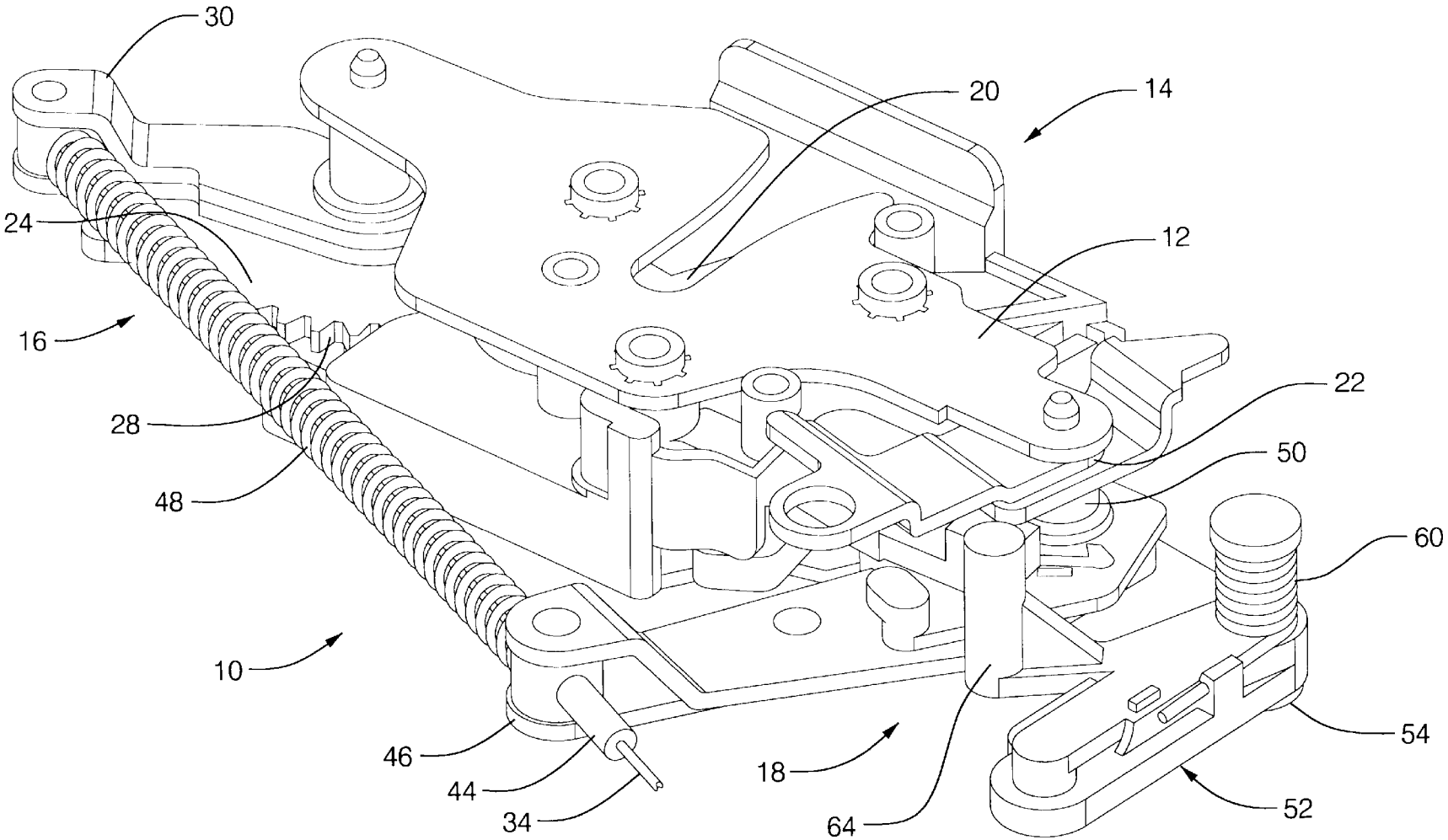
FIG. 1C is a perspective view from the lower left end of the present door latch also the fork bolt in the unlatched position.

Now the invention will be discussed in terms of its operation. FIGS. 1A–C show the fork bolt 20 in its unlatched position. FIG. 2 shows the fork bolt 20 in the secondary latched position. The scenario in FIG. 2 might occur if someone closes the door with sufficient force to effect minimal latching, but not enough force to fully close the door. The door will be latched, but will appear to be slightly ajar. As mentioned, some circuitry will sense this condition, and control the drive 36 accordingly. The cinching mechanism 16 will then drive the fork bolt 20 into the primary, i.e. fully, latched position shown in FIG. 3. The cinching mechanism 16 accomplishes this in the following manner. The cable drive 36 draws or winds the cable 34. The cable 34 in turn pulls or drives the gear lever 30 downwardly, or counter-clockwise as shown in FIG. 3. The cam 32 on the gear lever 30 will engage and drive the cinching gear 24—also in the counter-clockwise direction. The cinching gear 24, in turn, drives the fork bolt 20 to the primary latched position—which is clockwise in FIG. 3. As this happens, the spring 48 is compressed into an energized state. Then, once the latching is completed, the circuitry will sense this and the drive 36 will reverse itself or otherwise release the cable 34, and allow the spring 48 to draw the cable upwardly as shown in FIGS. 1–7, and also bias the gear lever 30 back to the upward, non-driving position shown in FIG. 4. When the gear lever 30 is in this position, it will not interfere with the unlatching of the latch, and the movement of the fork bolt 20 to the unlatched position. This sequence of operation is the normal function of the cinching mechanism 16.

However, if the drive 36 fails to return to its relaxed or neutral position wherein the cable 34 is released, reversed, unwound etc. and the gear lever 30 is up, there is a need for an override mechanism that will allow the latch to open. Here, a person can override the drive 36 by pulling either the latch handle 22 or the release cable 62. In either case, the detent 52 will disengage the conduit lever 46 and allow the conduit 44 to move upwardly as shown in FIGS. 5 and 6. This has the effect of allowing the gear lever 30 to move upwardly into its non-driving or neutral position. This happens even though the cable 34 is still held by the drive 36. Note that the distance between the gear lever 30 and the conduit lever 46 is still the shortened distance associated with cinching; and the spring 48 is still in its compressed state. However, the person can unlatch the latch 14 and move the fork bolt 20 to its unlatched position without any interference from the cinching mechanism 16. This is shown in FIGS. 5 and 6. The fork bolt 20 can even move back to one of the latched conditions as shown in FIGS. 7A and 7B. When the drive 36 is repaired and allows the cable 34 to return to its original, i.e. relaxed or neutral, length, the spring 48 biases the conduit lever 46 downwardly and back into engagement with the detent 52. The detent 52 is also biased upwardly by its detent spring 60.

Persons of skill in the art will appreciate that the conduit lever 46 can be used at either end of the conduit 44 to achieve the same effect, which is to permit one end of the conduit 44 to move and allow the fork bolt 20 to rotate if the drive 36 does not release or reverse the cable 34.

We claim:

1. A door latch with a cinching mechanism having a manual override comprising:

an enclosure;

a latching mechanism including a fork bolt pivotally mounted on the enclosure about a fork bolt axis operable for selective movement between an unlatched position, a secondary latched position, and a primary latched position;

a cinching mechanism including:

a cinching gear pivotally mounted on the enclosure adjacent the fork bolt about a cinching gear axis, the cinching gear engaging the fork bolt and being operable to drive the fork bolt to the primary latched position;

a gear lever moveably supported on the enclosure adjacent the cinching gear and being operable to drive the cinching gear;

an elongated cinching cable having a first end and a second end, the first end being attached to the gear lever;

a cable drive disposed at the second end of the cinching cable and being operable to pull and release the cable;

a cable conduit extending over and supporting a length of the cable between the drive and the gear lever, the cable conduit having a first end disposed adjacent the drive and a spaced-apart second end disposed adjacent the enclosure;

a conduit lever attached to the enclosure remote from the gear lever, the second end of the cable conduit attached to the conduit lever;

a spring extending along the cable and having a first end and a second end, the first end disposed adjacent the conduit lever and the second end disposed adjacent the gear lever; and a manual override including:

a pivoting connection interconnecting the conduit lever and the enclosure to allow the conduit lever and the conduit to pivot with respect to the enclosure selectively between a fixed position and loose position; and a detent supported on the enclosure adjacent the conduit lever and operable to move from an engaged position in which the detent engages the conduit lever and retains the conduit lever in the fixed position, to a disengaged position in which the detent disengages the conduit lever to allow the conduit lever to pivot to the loose position.

2. The door latch of claim 1 wherein the detent includes a release cable extending away from the detent that can be pulled to move the detent into the disengaged position.

3. The door latch of claim 1 wherein the latching mechanism includes a latch handle assembly interconnected with the fork bolt and operative to move from a neutral position to an unlatching position wherein the latch handle assembly drives the fork bolt to the unlatched position.

4. The door latch of claim 3 wherein the detent includes an abutment disposed adjacent the latch handle assembly so that the latch handle assembly will engage the abutment and move the detent into the disengaged position when the latch handle assembly moves to the unlatching position.

5. The door latch of claim 1 wherein the spring is a helical compression spring.

6. The door latch of claim 1 wherein the fork bolt includes a first set of gear teeth and the cinching gear includes a second set of gear teeth engaging the first set of gear teeth on the fork bolt.

7. The door latch of claim 1 wherein the gear lever is pivotally mounted on the enclosure about the cinching gear axis.

8. The door latch of claim 7 wherein the gear lever includes a cam for engaging and driving the cinching gear.

9. The door latch of claim 1 wherein the drive includes an electric motor assembly.

10. A door latch with a cinching mechanism having a manual override comprising:

an enclosure;

a latching mechanism including a fork bolt pivotally mounted on the enclosure and operable for selective movement between an unlatched position, a secondary latched position, and a primary latched position;

a cinching mechanism including:

an elongated cinching cable having a first end and a second end, the first end being interconnected with the fork bolt;

a cable drive disposed at the second end of the cinching cable and being operable to pull and release the cable;

a cable conduit extending over and supporting a length of the cable between the drive and the enclosure, the cable conduit having a first end disposed adjacent the drive and a spaced-apart second end disposed adjacent the enclosure;

a conduit lever attached to one of the enclosure and the drive at an attachment point, with one end of the cable conduit being attached to the conduit lever; and a manual override including:

a pivoting connection at the attachment point to allow the conduit lever and the conduit to pivot selectively between a fixed position and loose position; and a detent supported adjacent the conduit lever and operable to move from an engaged position in which the detent engages the conduit lever and retains the conduit lever in the fixed position, to a disengaged position in which the detent disengages the conduit lever to allow the conduit lever to pivot to the loose position.

* * * * *